US005201822A

United States Patent [19]

Chen

[11] Patent Number: 5,201,822

[45] Date of Patent: Apr. 13, 1993

[54] ARRANGEMENTS FOR AN AUTOMATIC VENDING MACHINE

[76] Inventor: Ming-Ho Chen, No. 166, Fu-Hsing Rd., Hsin-Ying City, Tainan Hsien, Taiwan

[21] Appl. No.: 801,015

[22] Filed: Dec. 2, 1991

[51] Int. Cl.[5] ..... G07F 11/00

[52] U.S. Cl. ..... 194/350; 49/398; 49/401; 221/281; 312/107.5; 312/326

[58] Field of Search ..... 194/344, 350, 351, 353; 221/281; 49/398, 399, 401, 402; 109/56, 73, 74, 79; 70/DIG. 43, DIG. 56; 312/107.5, 109, 216, 326, 329

[56] References Cited

U.S. PATENT DOCUMENTS

| | | | |
|---|---|---|---|
| 2,574,641 | 11/1951 | Herron | 49/401 |
| 2,883,849 | 4/1959 | Lorenzo | 70/DIG. 56 |
| 4,186,460 | 2/1980 | Artman | 49/398 X |
| 4,903,816 | 2/1990 | Reeder et al. | 194/350 |

FOREIGN PATENT DOCUMENTS

| | | | |
|---|---|---|---|
| 1213868 | 4/1960 | France | 194/350 |

*Primary Examiner*—F. J. Bartuska
*Attorney, Agent, or Firm*—Baker & Daniels

[57] ABSTRACT

Arrangements are provided for an automatic vending machine, including a vertical support frame, a top plate mounted securely on the top end of the support frame, and a bottom plate mounted securely on the bottom end of the support frame. An L-cross-sectioned side plate is hinged to a side wall of the support frame. A rib arrangement is provided on the side plate and includes an L-shaped first horizontal rib, an L-shaped second horizontal rib, an L-shaped third horizontal rib, an L-shaped fourth horizontal rib and a vertical rib. The first horizontal rib is positioned just over the top plate. The second horizontal rib is positioned just under the top plate. The entire length of the second horizontal rib extends under an intermediate portion of the first horizontal rib, so as to conceal an L-shaped peripheral plate portion of the top plate between the first and second horizontal ribs. The third horizontal rib is positioned just under the bottom plate. The fourth horizontal rib is positioned just over the bottom plate. The entire length of the fourth horizontal rib extends over an intermediate portion of the third horizontal rib, so as to conceal an L-shaped peripheral plate portion of the bottom plate between the third and fourth horizontal ribs. The vertical rib connects an end of the second horizontal rib to an end of the fourth horizontal rib.

6 Claims, 7 Drawing Sheets

ARRANGEMENTS FOR AN AUTOMATIC VENDING MACHINE

BACKGROUND OF THE INVENTION

1. Field of the Invention

This invention relates to an automatic vending machine, more particularly to improved arrangements for an automatic vending machine which prevent thieves from illegal accession to the merchandise and coins in the machine.

2. Description of the Related Art

The arrangements of this invention are directed to some arrangements of a conventional automatic vending machine, which are shown in FIG. 1. As illustrated, the automatic vending machine has a housing 1 which includes a vertical support frame 11 disposed at the middle portion of the machine, and a back plate 12 mounted securely on the back portion of the support frame 11. Two L-cross-sectioned side plates 2 are connected pivotally to two opposite sides of the back plate 12 by means of several hinges 1A. Two rib arrangements or peripheral ribs 21A respectively project from the peripheries of the side plates 2. Each of the side plates 2 includes a key driven element 22 mounted rotatably thereon, which has a keyhole 22A. Two latch holes 111 are respectively formed through two side walls of the support frame 11. Two L-shaped latch elements 23 are respectively secured to the key driven elements 22. As best shown in FIG. 3, each of the L-shaped latch elements 23 extends into the corresponding latch hole 111 of the support frame 11 at an end thereof, so as to fasten the corresponding side plate 2 to the support frame 11. The latch holes 111, the key driven elements 22 and the L-shaped latch elements 23 constitute two lock arrangements each of which fastens one of the side plates 2 to the support frame 11. When it is desired to open one of the side plates 2, the corresponding key driven element 22 is rotated about a horizontal axis by actuating a key which is inserted into the keyhole 22A of the key driven element 22, so that the L-shaped latch element 23 can be removed from the corresponding latch hole 111 of the support frame 11. Again referring to FIG. 1, the side plates 2 are opened for clarity. A top plate 13 and a bottom plate 14 are respectively fixed on the top and bottom ends of the support frame 11. When the side plates 2 are fastened to the support frame 11, the horizontal upper end portions of the ribs 21A are positioned just under the top plates 13, while the horizontal lower end portions of the ribs 21A are positioned just over the bottom plates 14. In this situation, the vertical portions of the ribs 21A are parallel and adjacent to the side walls of the support frame 11. The front wall 11A of the support frame 11 has six rectangular upper openings 112 for mounting pushbuttons (not shown) therein, a rectangular intermediate opening 113, and a rectangular lower opening 114 accommodating a merchandise discharge casing (not shown) therein. A coin slot arrangement includes a coin slot member 3 which is screwed into the intermediate opening 113. The machine suffers from the following drawbacks:

(1) Referring to FIG. 2, gaps (A) are formed between the top plate 13 and the horizontal upper end portions of the ribs 21A. Similarly, gaps are formed between the bottom plate 14 and the horizontal lower end portions of the ribs 21A, and between the side walls of the support frame 11 and the vertical portions of the ribs 21A. A thief may insert a lever into one of such gaps in order to pry open the housing 1.

(2) The size of the intermediate opening 113 of the support frame 11 is large enough to permit one hand of a thief to take coins from the interior of the machine therethrough when the coin slot member 3 is removed from the support frame 11 by the thief.

(3) A thief can rotate the key driven elements 23 by means of a set of unlocking tools so as to open the side plates 2 for the purpose of taking merchandise from the interior of the machine.

(4) Referring to FIGS. 4A and 4B, a thief may insert an elongated lever into one of the gaps (B) formed between the hinges 12 and the side plates 2 in order to pry open the housing 1.

SUMMARY OF THE INVENTION

It is therefore the main object of this invention to provide improved arrangements for an automatic vending machine which prevent the merchandise and coins in the machine from being illegally accessed.

According to this invention, arrangements are provided for an automatic vending machine, including a vertical support frame, a top plate mounted securely on the top end of the support frame, and a bottom plate mounted securely on the bottom end of the support frame. An L-cross-sectioned side plate is hinged to a side wall of the support frame and has an improved rib arrangement provided thereon.

The rib arrangement includes an L-shaped first horizontal rib, an L-shaped second horizontal rib, an L-shaped third horizontal rib, an L-shaped fourth horizontal rib and a vertical rib. The first horizontal rib is positioned just over the top plate. The second horizontal rib is positioned just under the top plate. The entire length of the second horizontal rib extends under an intermediate portion of the first horizontal rib, so as to conceal an L-shaped peripheral plate portion of the top plate between the first and second horizontal ribs. The third horizontal rib is positioned just under the bottom plate. The fourth horizontal rib is positioned just over the bottom plate. The entire length of the fourth horizontal rib extends over an intermediate portion of the third horizontal rib, so as to conceal an L-shaped peripheral plate portion of the bottom plate between the third and fourth horizontal ribs. The vertical rib connects an end of the second horizontal rib to an end of the fourth horizontal rib. Accordingly, it is difficult to pry open the housing of the machine by a lever.

An improved coin slot arrangement includes a coin slot member secured to the front wall of the support frame, a coin inlet formed through the coin slot member, a coin outlet formed through the coin member, an upper coin slot formed in the front wall in alignment with the coin inlet, and a lower coin slot formed in the front wall below the upper coin slot and aligned with the coin outlet. The upper and lower coin slots are too small in size to permit one hand of a thief to take coins from the interior of the machine therethrough.

A double lock arrangement includes a key driven element mounted rotatably on the side plate which has a keyhole. An L-shaped latch element is secured to the key driven element at an end thereof. The other end of the L-shaped latch element extends into the latch hole of the support frame, so as to fasten the side plate to the support frame. A lock unit also fastens the side plate to the support frame. A cover is fastened to the side plate and the support frame by means of the lock unit and covers the key driven element on the side plate.

A hinge arrangement includes a hinge member connecting rotatably the side plate to the support frame. The hinge member has a first leaf connected securely to the support frame and a second leaf connected pivotally to the first leaf and having a generally U-shaped cross-section which defines a groove. The side plate has a generally Z-shaped end portion with an L-shaped distal end which is secured in the groove of the second leaf of the hinge member. The Z-shaped end portion of the side plate is positioned relative to the second leaf so that a thief cannot insert an elongated lever into a space between the Z-shaped end portion of the side plate and the second leaf from the exterior of the machine to an extent which would enable the thief to separate forcibly the side plate from the hinge member.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 5:
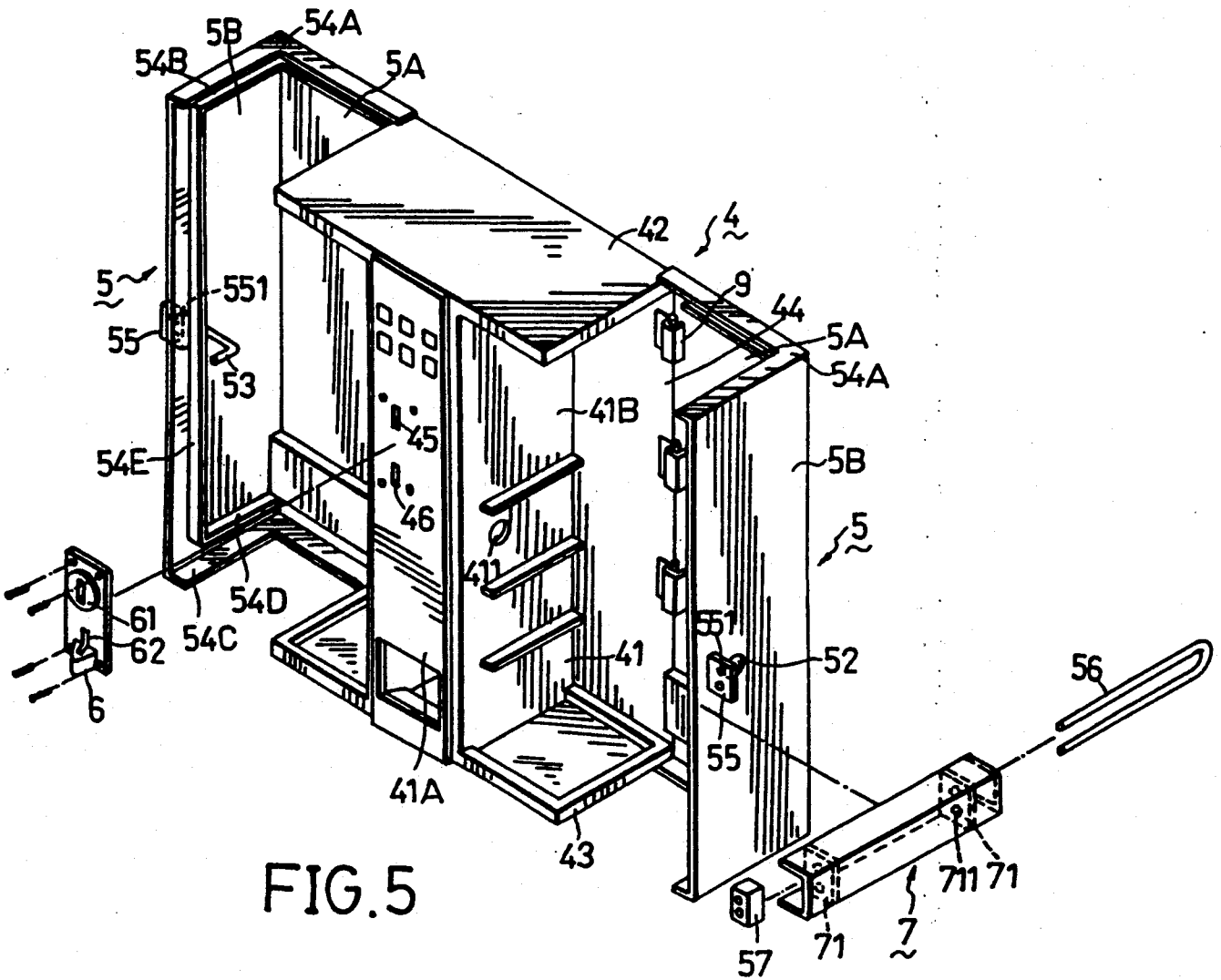
FIG. 5 is a perspective view illustrating improved arrangements for an automatic vending machine according to a first embodiment of this invention.

Referring to FIG. 5, several improved arrangements of this invention are provided on an automatic vending machine having a housing 4 which includes a vertical support frame 41, a top plate 42 mounted securely on the top end of the support frame 41, and a bottom plate 43 mounted securely on the bottom end of the support frame 41. A back plate 44 is mounted securely on the back portion of the support frame 41. Two L-cross-sectioned side plates 5 are hinged to the back plate 44. Each of the side plates 5 consists of a pivoted plate portion 5A and a fastening plate portion 5B which are rectangular to each other. The pivoted plate portion 5A is connected pivotally to the back plate 44 by a hinge arrangement. The fastening plate portion 5B is fastened to the support frame 41. Each of the side plates 5 has a rib arrangement which includes an L-shaped first horizontal rib 54A, an L-shaped second horizontal rib 54B, an L-shaped third horizontal rib 54C, an L-shaped fourth horizontal rib 54D and a vertical rib 54E.

Figure 6:
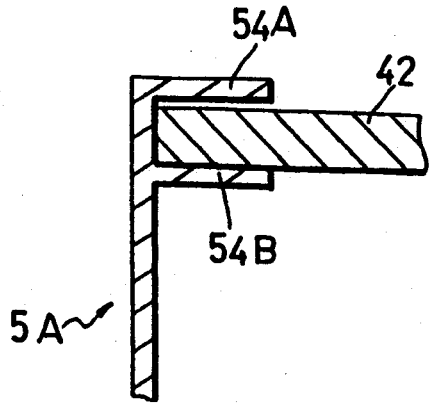
FIG. 6 is a sectional view illustrating the positions of first and second horizontal ribs relative to the top plate of the automatic vending machine according to the first embodiment of this invention.

The first horizontal rib 54A projects from the upper end of the side plate 5 and is positioned just over the top plate 42. The second horizontal rib 54B projects from the upper end portion of the side plate 5 and is positioned just under the top plate 42. The entire length of the second horizontal rib 54B extends under an intermediate portion of the first horizontal rib 54A, so as to conceal an L-shaped peripheral plate portion of the top plate 42 between the first and second horizontal ribs 54A and 54B. The third horizontal rib 54C projects from the lower end of the side plate 5 and is positioned just under the bottom plate 43. The fourth horizontal rib 54D projects from the lower end portion of the side plate 5 and is positioned just over the bottom plate 43. The entire length of the fourth horizontal rib 54D extends over an intermediate portion of the third horizontal rib 54C, so as to conceal an L-shaped peripheral plate portion of the bottom plate 43 between the third and fourth horizontal ribs 54C and 54D. The vertical rib 54E projects from the fastening plate portion 5B of the side plate 5 and connects an end of the second horizontal rib 54B to an end of the fourth horizontal rib 54D. As shown in FIG. 6, since the L-shaped peripheral plate portion of the top plate 42 is interposed between the first and second horizontal ribs 54A, 54B, it is difficult or time-consuming to pry open the portion of the side plate 5 which is adjacent to the top plate 42. Similarly, the L-shaped peripheral plate portion of the bottom plate 43 is concealed between the third and fourth horizontal ribs 54C, 54D.

Figure 2:
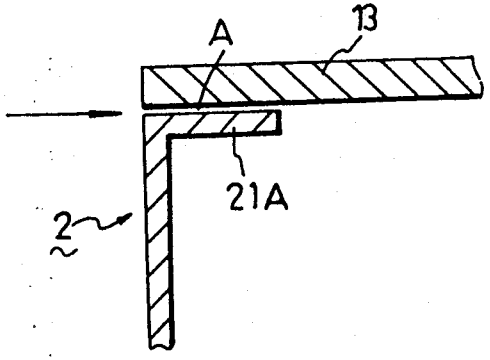
FIG. 2 PRIOR ART
FIG. 2 is a schematic view illustrating the gap between the housing and the side plate of the conventional automatic vending machine.
Figure 1:
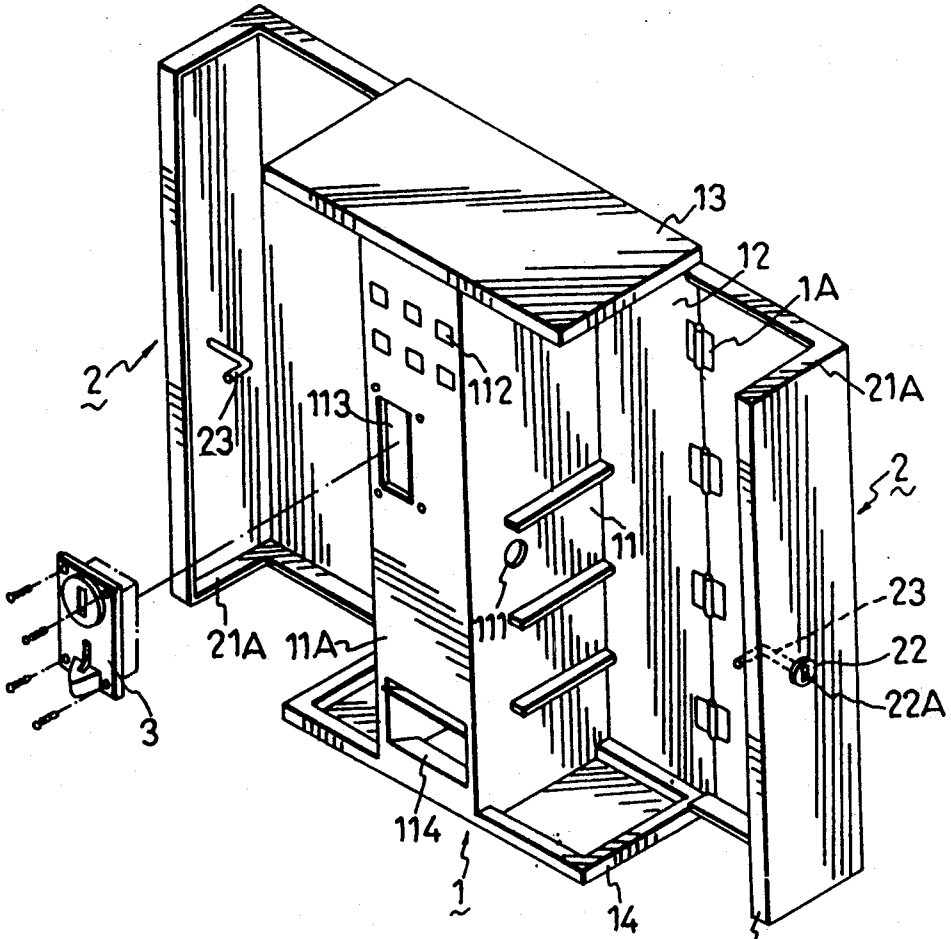
FIG. 1 PRIOR ART
FIG. 1 is a perspective view showing a portion of a conventional automatic vending machine.
Figure 3:
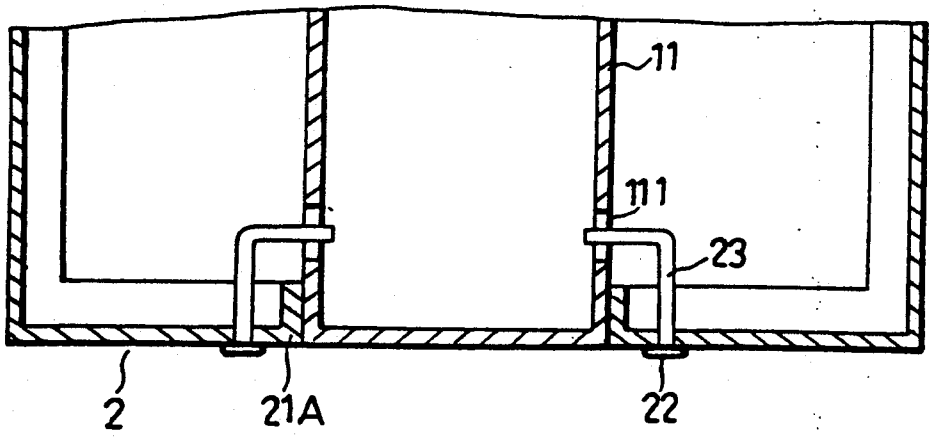
FIG. 3 PRIOR ART
FIG. 3 is a schematic view illustrating how to fasten the side plate to the support frame of the conventional automatic vending machine.
Figure 4A:
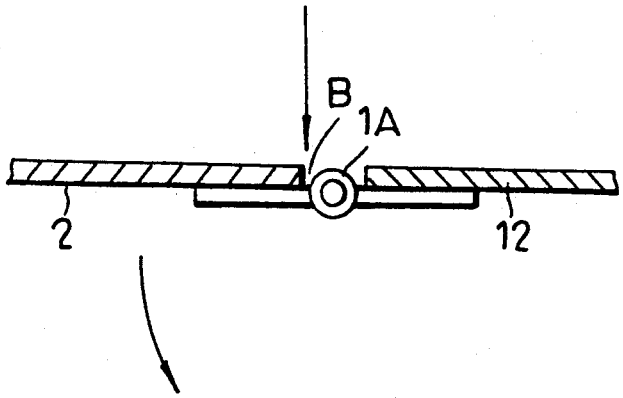
FIG. 4A PRIOR ART
FIG. 4A is a sectional view illustrating the gap between the hinge member and the L-cross-sectioned side plate of the conventional automatic vending machine when the side plate is opened.
Figure 4B:
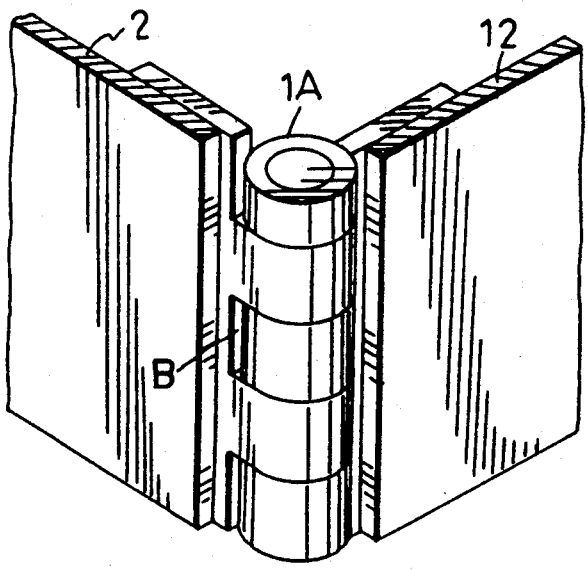
FIG. 4B PRIOR ART
FIG. 4B is a perspective view illustrating the gap between the hinge member and the L-cross-sectioned side plate of the conventional automatic vending machine when the side plate is closed.

Again referring to FIG. 5, a coin slot member 6 is screwed to the front wall 41A of the support frame 41 and has a coin inlet 61 and a coin outlet 62 which are formed therethrough. An upper coin slot 45 is formed in the front wall 41A in alignment with the coin inlet 61. A lower coin slot 46 is formed in the front wall 41A below the upper coin slot 45 in alignment with the coin outlet 62. The upper and lower coin slots 45, 46 are too small in size to permit one hand of a thief to take coins from the interior of the machine therethrough. Accordingly, the coin slot arrangement of this invention, which consists of the coin slot member 6, the coin inlet 61, the coin outlet 62, the upper coin slot 45 and the lower coin slot 46, is an improvement over the conventional coin slot arrangement shown in FIG. 1.

Figure 7:
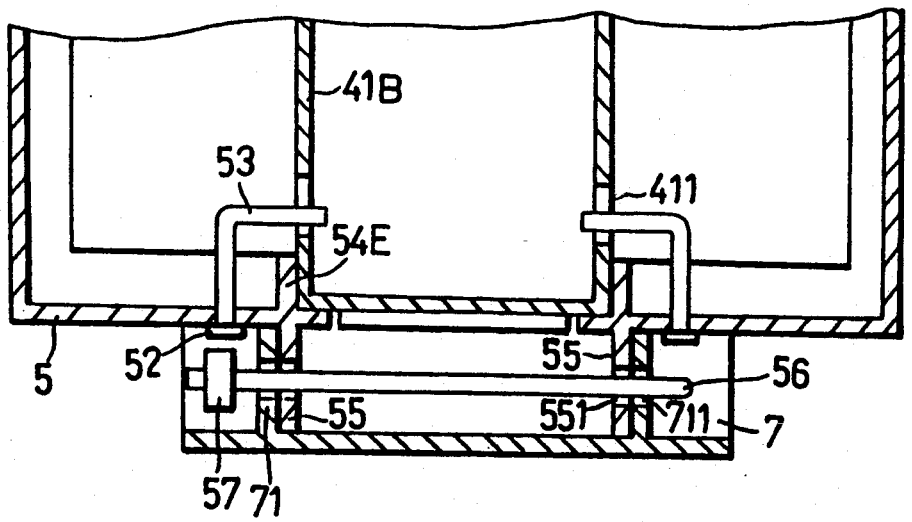
FIG. 7 is a schematic view illustrating the double lock arrangement of the automatic vending machine according to the first embodiment of this invention.

Referring to FIGS. 5 and 7, a double lock arrangement fastens the side plates 5 to the support frame 41. As illustrated, the support frame 41 has two side walls 41B through which two latch holes 411 are formed. Each of the side plates 5 includes a key driven element 52 mounted rotatably thereon in a known manner, and an L-shaped latch element 53 secured to the key driven elements 52 in a known manner. The L-shaped latch element 53 extends into the latch hole 411 of the support frame 41, so as to fasten the side plate 5 to the support frame 41. When it is desired to open one of the side plates 5, the corresponding L-shaped latch element 53 is removed from the corresponding latch hole 411 of the support frame 41 by rotating the key driven element 52. Each of the side plates 5 further includes a positioning lug 55 projecting from the outer surface thereof, which is adjacent to the corresponding key driven element 52. Each of the lugs 55 has a pair of first shackle holes 551 formed therethrough. A cover 7 has a generally U-shaped cross-section and extends across the front wall 41A of the support frame 41 so as to cover the key driven elements 52 and the positioning lugs 55. Two positioning plates 71 are secured in the cover 7. Each of the positioning plates 71 has two second shackle holes 711 formed therethrough in alignment with the first shackle holes 551. The cover 7 is secured to the side plates 5 by a lock unit 56. The lock unit consists of a shackle extending through the first shackle holes 551 and second shackle holes 711, and a lock body 57 connected to the shackle 56 and positioned in an end of the cover 7.

When the lock body 57 is opened by a key, the lock unit 56 and the cover 7 can be removed from the support frame 41 and the side plates 5, so that another key can be inserted into the keyhole of one of the key driven elements 52, thereby opening the corresponding side plate 5.

Figure 8A:
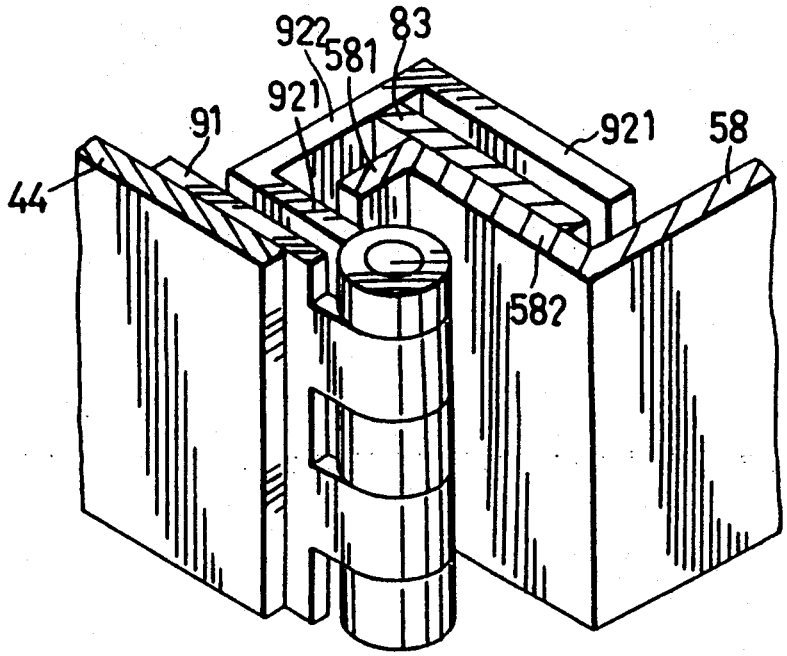
FIG. 8A is a perspective view illustrating a hinge arrangement of the automatic vending machine according to the first embodiment of this invention, in a case where the side plate is closed.
Figure 8B:
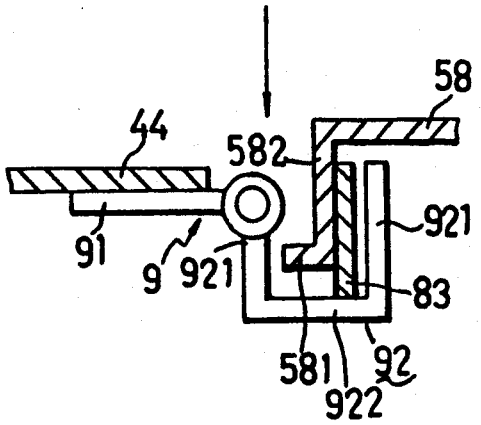
FIG. 8B is a sectional view illustrating the hinge arrangement of the automatic vending machine according to the first embodiment of this invention, in a case where the side plate is opened.

Referring to FIG. 5, a hinge arrangement consists of several hinge members 9. As shown in FIG. 8A and 8B, each of the hinge members 9 have a first leaf 91 connected securely to the back plate 44 and a second leaf 92 connected pivotally to the first leaf 91. The second leaf 92 has a generally U-shaped cross-section defining a groove therein, which has two side walls 921 and a bottom wall 922. Each of the side plates 5 has a generally Z-shaped end portion 58 with an L-shaped distal end which extends into the groove of the second leaf 92. The Z-shaped end portion 58 has a stop plate 581 extending in a direction parallel to the bottom wall 922, and a connecting plate 582 extending in a direction parallel to the side walls 921. The Z-shaped end portion 58 of the side plate 5 is secured to the second leaf 92 by means of an inner plate 83 which is welded to both the bottom wall 922 and the stop plate 582. As a consequence, a thief cannot insert an elongated lever into a space between the Z-shaped end portion 58 of the side plate 5 and the second leaf 92 from the exterior of the machine to an extent which would enable the thief to separate forcibly the side plate 5 from the hinge member 9.

Figure 9:
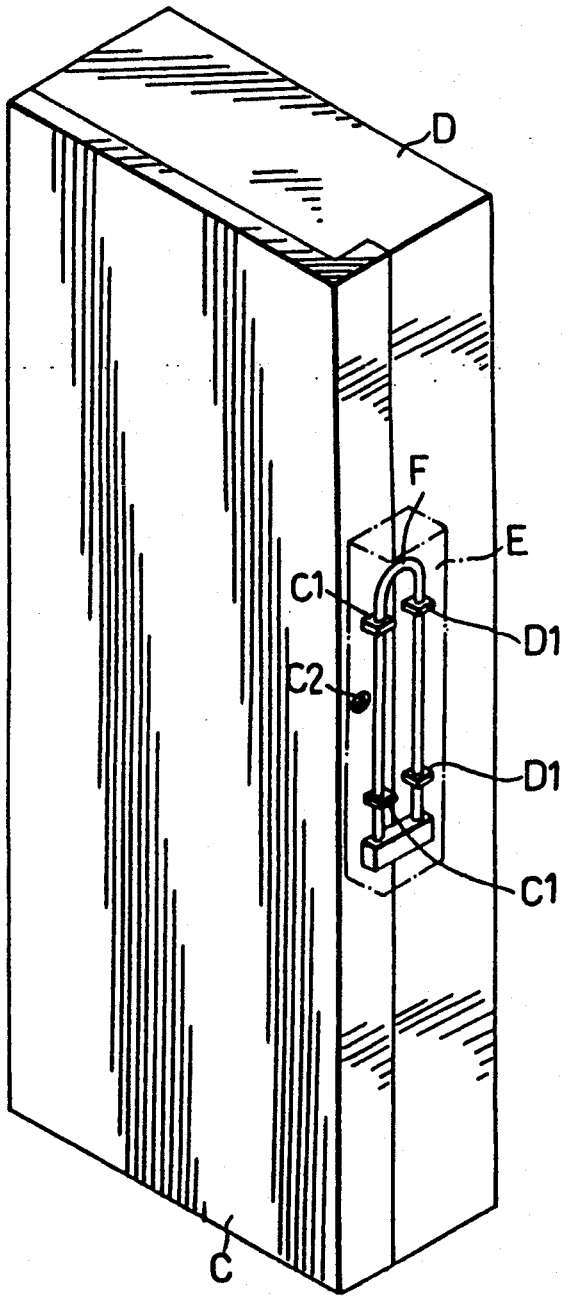
FIG. 9 is a schematic view illustrating improved arrangements for an automatic vending machine according to a second embodiment of this invention.

FIG. 9 shows another embodiment of this invention. As illustrated, unlike the previous embodiment, only one side plate (C) is hinged to a support frame (D). Two first positioning lugs C1 are fixed on the side plate (C). Two second positioning lugs D1 are fixed on the support frame (D). As illustrated, each of the lugs C1 and D1 has a first shackle hole formed therethrough. A cover (E) is secured to both the side plate (C) and the support frame (D) by a lock unit (F), so as to cover a key driven element (C2) on the side plate (C). The shackle of the lock unit (F) extends through the lugs C1, D1 and the second shackle holes of two positioning sheets (not shown) of the cover (E), so as to interlock the side plate (C) and the support frame (D).

With this invention thus explained, it is apparent that numerous modifications and variations can be made without departing from the scope and spirit of this invention. It is therefore intended that this invention be limited only as indicated in the appended claims.

I claim:

1. An automatic vending machine comprising:

a housing including a vertical support frame having a side wall through which a latch hole is formed, a top plate mounted securely on a top of said support frame, and a bottom plate mounted securely on a bottom of said support frame;

an L-cross-sectioned side plate comprising a pivoted plate portion and a fastening plate portion disposed generally perpendicular to and connected with each other, said pivoted plate portion pivotally connected to said side wall, said fastening plate portion connectable to said side wall;

a rib arrangement provided on said side plate, said rib arrangement comprising:

an L-shaped first horizontal rib positioned just over said top plate;

an L-shaped second horizontal rib positioned just under said top plate, said second horizontal rib having a length extending under an intermediate portion of said first horizontal rib;

an L-shaped third horizontal rib positioned just under said bottom plate;

an L-shaped fourth horizontal rib positioned just over said bottom plate, said fourth horizontal rib having a length extending over an intermediate portion of said third horizontal rib; and a vertical rib projecting from said fastening plate portion of said side plate and connecting an end of said second horizontal rib to an end of said fourth horizontal rib;

a double lock arrangement for fastening said side plate to said support frame, said double lock arrangement comprising:

a key driven element, mounted rotatably on said side plate, rotatable about a horizontal axis, having a keyhole formed therein;

an L-shaped latch element secured to said key driven element at an end thereof and extending into said latch hole of said support frame so as to fasten said side plate to said support frame, rotation of said key driven element enabling said latch element to be removed from said latch hole of said support frame;

two first positioning lugs projecting from an outer surface of said side plate;

two second positioning lugs projecting from an outer surface of said support frame, each of said first and second positioning lugs having a first shackle hole formed therethrough;

a cover having a generally U-shaped cross-section and being positioned so as to cover said key driven element and said first and second positioning lugs on said side plate and said support frame;

two positioning plates secured in said cover, each of said positioning plates having two second shackle holes formed therethrough in alignment with said first shackle holes; and a lock unit consisting of a shackle extending through said first shackle holes of said first and second positioning lugs and said second shackle holes of said positioning plates, and a lock body connected to said shackle and positioned in an end of said cover;

whereby, when said lock body is opened with a key, said lock unit and said cover can be removed from said side plate and said support frame, so that another key can be inserted into said keyhole of one of said key driven elements, thereby opening said corresponding side plate.

2. The automatic vending machine of claim 1, wherein said support frame includes a front wall and a coin slot member mounted securely on said front wall, said coin slot member having a coin inlet and a coin outlet which are formed therethrough, said front wall having an upper coin slot formed therein in alignment with said coin inlet, and a lower coin slot formed in said front wall below said upper coin slot and aligned with said coin outlet.

3. The automatic vending machine of claim 1, further comprising a hinge arrangement including a hinge member connecting rotatably said side plate to said support frame, said hinge member having a first leaf connected securely to said support frame and a second leaf connected pivotally to said first leaf and having a generally U-shaped cross-section defining a groove therein, said side plate having a generally Z-shaped end portion with an L-shaped distal end which is secured in said groove of said second leaf, said Z-shaped end portion of said side plate being positioned relative to said second leaf, so as to prevent a thief from inserting an elongated lever into a space between said Z-shaped end portion of said side plate and said second leaf from exterior of said machine to an extent which would enable the thief to separate forcibly said side plate from said hinge member.

4. An automatic vending machine comprising:

a housing including a vertical support frame having two side walls, a top plate mounted securely on a top of said support frame, and a bottom plate mounted securely on a bottom of said support frame;

two L-cross-sectioned side plates, said side plates each comprising a pivoted plate portion and a fastening plate portion disposed generally perpendicular to and connected with each other, each said pivoted plate portion respectively and pivotally connected to said side walls;

a rib arrangement provided on said side plate, said rib arrangement comprising:

an L-shaped first horizontal rib positioned just over said top plate;

an L-shaped second horizontal rib positioned just under said top plate, said second horizontal rib having a length extending under an intermediate portion of said first horizontal rib;

an L-shaped third horizontal rib positioned just under said bottom plate;

an L-shaped fourth horizontal rib positioned just over said bottom plate, said fourth horizontal rib having a length extending over an intermediate portion of said third horizontal rib; and a vertical rib projecting from said fastening plate portion of said side plate and connecting an end of said second horizontal rib to an end of said fourth horizontal rib;

a double lock arrangement for fastening said side plates to said support frame, said double lock arrangement comprising:

two latch holes respectively formed through said side walls of said support frame;

two key driven elements respectively and rotatably mounted on said side plates and rotatable about a horizontal axis, each of said key driven elements having a keyhole formed therein;

two L-shaped latch elements each secured to one of said key driven elements at an end thereof and extending into one of said latch holes of said support frame, so as to fasten said side plate to said support frame, rotation of said key driven element enabling said L-shaped latch element to be removed from said latch hole of said support frame;

two positioning lugs respectively projecting from an outer surface of said side plates, each of said positioning lugs having two first shackle holes formed therethrough;

a cover having a generally U-shaped cross-section and positioned so as to cover said key driven elements and said positioning lugs on said side plates;

two positioning plates secured in said cover, each of said positioning plates having two second shackle holes formed therethrough in alignment with said first shackle holes; and a lock unit consisting of a shackle extending through said first shackle holes of said lugs and said second shackle holes of said positioning plates, and a lock body connected to said shackle and positioned in an end of said cover;

whereby, when said lock body is opened with a key, said lock unit and said cover can be removed from said side plates so that another key can be inserted into said keyhole of one of said key driven elements, thereby opening said corresponding side plate.

5. Improved arrangements are claimed in claim 4, wherein said support frame includes a front wall and a coin slot member mounted securely on said front wall, said coin slot member having a coin inlet and a coin outlet which are formed therethrough, said front wall having an upper coin slot formed therein in alignment with said coin inlet, and a lower coin slot formed in said front wall below said upper coin slot and aligned with said coin outlet.

6. The automatic vending machine of claim 4, further comprising a hinge arrangement including a hinge member connecting rotatably said side plate to said support frame, said hinge member having a first leaf connected securely to said support frame and a second leaf connected pivotally to said first leaf and having a generally U-shaped cross-section defining a groove therein, said side plate having a generally Z-shaped end portion with an L-shaped distal end which is secured in said groove of said second leaf, said Z-shaped end portion of said side plate being positioned relative to said second leaf, so as to prevent a thief from inserting an elongated lever into a space between said Z-shaped end portion of said side plate and said second leaf from exterior of said machine to an extent which would enable the thief to separate forcibly said side plate from said hinge member.

* * * * *